US009959819B2

(12) United States Patent
Jin

(10) Patent No.: US 9,959,819 B2
(45) Date of Patent: May 1, 2018

(54) RGB TO RGBW BRIGHTNESS COMPENSATION METHOD AND DEVICE

(71) Applicant: Shenzhen China Star Optoelectronics Technology Co., Ltd., Shenzhen, Guangdong (CN)

(72) Inventor: Yufeng Jin, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 242 days.

(21) Appl. No.: 14/906,535

(22) PCT Filed: Aug. 28, 2015

(86) PCT No.: PCT/CN2015/088364

§ 371 (c)(1),
(2) Date: Jan. 20, 2016

(87) PCT Pub. No.: WO2017/024625

PCT Pub. Date: Feb. 16, 2017

(65) Prior Publication Data

US 2017/0186383 A1 Jun. 29, 2017

(30) Foreign Application Priority Data

Aug. 13, 2015 (CN) ..... 2015 1 0496515

(51) Int. Cl.
*G09G 3/36* (2006.01)
*G09G 3/20* (2006.01)

(52) U.S. Cl.
CPC ..... *G09G 3/3607* (2013.01); *G09G 3/2003* (2013.01); *G09G 3/2074* (2013.01); *G09G 2320/0223* (2013.01); *G09G 2320/0646* (2013.01); *G09G 2320/0666* (2013.01)

(58) Field of Classification Search
CPC ... G09G 2320/0223; G09G 2320/0646; G09G 2320/0666; G09G 3/2003; G09G 3/2074; G09G 3/3607
See application file for complete search history.

(56) References Cited

U.S. PATENT DOCUMENTS 9,183,797 B2 * 11/2015 Takahashi ..... G09G 3/2003
2012/0262476 A1 * 10/2012 Lee ..... G09G 3/2003 345/603
2014/0028739 A1 * 1/2014 Takahashi ..... G09G 3/2003 345/690

* cited by examiner

*Primary Examiner* — Afroza Chowdhury
(74) *Attorney, Agent, or Firm* — Andrew C. Cheng

(57) ABSTRACT

An RGB to RGBW brightness compensation method and device is disclosed. The method includes: retrieving multiple gray scale values of RGB color RGB(x, y, z), wherein x, y, z are gray scale levels of red, green and blue sub-pixels of an RGB model, $0 \leq x, y, z \leq 1$; multiplying the gray scale values of RGB color RGB (x, y, z) by N to obtain an enhanced gray scale values of RGB color RGB (Nx, Ny, Nz), wherein N is ⅔ and a minimum value selected from x, y, z is taken to represent a first conversion value W1; and obtaining multiple gray scale values of RGBW color RGBW (Nx−W1, Ny−W1, Nz−W1, W1) according to the enhanced gray scale values of RGB color RGB (Nx, Ny, Nz) and the first conversion value W1. Accordingly, a brightness of the RGBW model of a liquid crystal panel is compensated.

11 Claims, 4 Drawing Sheets

RGB TO RGBW BRIGHTNESS COMPENSATION METHOD AND DEVICE

CROSS-REFERENCE TO RELATED APPLICATIONS

This application claims the priority of Chinese Patent Application No. 201510496515.X, entitled "RGB to RGBW brightness compensation method and device", filed on Aug. 13, 2015, the disclosure of which is incorporated herein by reference in its entirety.

FIELD OF THE INVENTION

The present disclosure relates to a liquid crystal display field, and more particularly to an RGB to RGBW brightness compensation method and device.

BACKGROUND OF THE INVENTION

As shown in FIG. 1, a pixel point of a conventional liquid crystal display panel includes three sub-pixels including red, green and blue (RGB). Each sub-pixel has a total of 256 from 0 to 255 gray scale levels. Different colors are formed by combining different gray scales of the red, green and blue sub-pixels. Thus, represented by the RGB model, RGB (X, Y, Z) can represent various colors, wherein X is a gray scale level of the red sub-pixel, Y is a gray scale level of the green sub-pixel and Z is a gray scale level of the blue sub-pixel, $0 \le X, Y, Z \le 255$. For example, red can be represented by RGB (255, 0, 0). RGB (X, Y, Z) is normalized to RGB (x, y, z), $0 \le x, y, z \le 1$, wherein x is a normalized gray scale level of red sub-pixel, y is a normalized gray scale level of the green sub-pixel and z is a normalized gray scale level of the blue sub-pixel.

Since a red light, a green light and a blue light are overlapped to form a write light, people innovate an RGBW model by adding a white sub-pixel on a basis of the conventional three basic colors RGB. As shown in the drawing, for a single pixel, compared with the RGB, the RGBW has the white sub-pixel. However, a size of an entire pixel is not changed, so the sizes of the red, green and blue sub-pixels of the RGBW are smaller than these of the RGB. In fact, the sizes of the red, green and blue sub-pixels of the RGBW is a ¾ of the sizes of the red, green and blue sub-pixels of the RGB.

In the present RGBW model, the red, green and blue sub-pixels respectively generate the red, green and blue lights with the same quantity, which are replaced by a white light generated by the white sub-pixel. When the quantities of the red, green and blue lights are respectively generated by the red, green and blue sub-pixels, the quantities of the red, green and blue lights include in the white light have to be subtracted. In an example of RGB (0.6, 0.3, 0.3), a 0.3 of the quantity of the red light, a 0.3 of the quantity of the green light and a 0.3 of the quantity of the blue light are replaced by the white light. The 0.3 of the quantity of the red light is subtracted from the 0.6 of the quantity of the red light, the 0.3 of the quantity of the green light is subtracted from the 0.3 of the quantity of the green light and the 0.3 of the quantity of the blue light is subtracted from the 0.3 of the quantity of the blue light. Thus, RGB (0.6, 0.3, 0.3) is converted to RGBW (0.3, 0, 0, 0.3). However, since the sizes of the red, green and blue sub-pixels of RGBW are the ¾ of these of the RGB, a real converted brightness is RGBW (0.3*¾, 0, 0, 0.3*¾).

SUMMARY OF THE INVENTION

The technical issue that the embodiment of the present disclosure solves is to provide a RGB to RGBW brightness compensation method and device to compensate a brightness of an RGBW model of a liquid crystal display panel.

The present provides the RGB to RGBW brightness compensation method and comprises: retrieving multiple gray scale values of RGB color RGB(x, y, z), wherein x is a gray scale level of a red sub-pixel of an RGB model, y is a gray scale level of a green sub-pixel of an RGB model and z is a gray scale level of a blue sub-pixel of an RGB model $0 \le x, y, z \le 1$; multiplying the gray scale values of RGB color RGB (x, y, z) by N to obtain multiple enhanced gray scale values of RGB color RGB (Nx, Ny, Nz), wherein N is ⅔ and a minimum value selected from x, y, z is taken to represent a first conversion value W1; obtaining multiple gray scale values of RGBW color RGBW (Nx−W1, Ny−W1, Nz−W1, W1) according to the enhanced gray scale values of RGB color RGB (Nx, Ny, Nz) and the first conversion value W1; and Gamma-converting the gray scale values of RGBW color RGBW (Nx−W1, Ny−W1, Nz−W1, W1).

Selectively, the method also comprises: determining whether one or more than one of Nx−W1, Ny−W1 and Nz−W1 is larger than 1; and if not, outputting the gray scale values of RGBW color RGBW (Nx−W1, Ny−W1, Nz−W1, W1); and if yes, taking a minimum value selected from Nx−W1, Ny−W1 and Nz−W1, to represent a second conversion value W2 and making the gray scale values of RGBW color to be RGBW (Nx−W1−W2, Ny−W1−W2, Nz−W1−W2, W1+W2).

Selectively, the method also comprises: determining whether one or more than one of Nx−W1−W2, Ny−W1−W2 and Nz−W1−W2 is larger than 1; and if not, outputting the gray scale values of RGBW color RGBW(Nx−W1−W2, Ny−W1−W2, Nz−W1−W2, W1+W2); and if yes, making a coordinate value corresponding to each gray scale value of RGBW color, which is larger than 1, to be 1.

The present provides the RGB to RGBW brightness compensation method and comprises: retrieving multiple gray scale values of RGB color RGB(x, y, z), wherein x is a gray scale level of a red sub-pixel of an RGB model, y is a gray scale level of a green sub-pixel of an RGB model and z is a gray scale level of a blue sub-pixel of an RGB model $0 \le x, y, z \le 1$; multiplying the gray scale values of RGB color RGB (x, y, z) by N to obtain multiple enhanced gray scale values of RGB color RGB (Nx, Ny, Nz), wherein N is $1 < N \le ⅔$ and a minimum value selected from x, y, z is taken to represent a first conversion value W1; and obtaining multiple gray scale values of RGBW color RGBW (Nx−W1, Ny−W1, Nz−W1, W1) according to the enhanced gray scale values of RGB color RGB (Nx, Ny, Nz) and the first conversion value W1.

Selectively, N is ⅔.

Selectively, the method also comprises: determining whether one or more than one of Nx−W1, Ny−W1 and Nz−W1 is larger than 1; and if not, outputting the gray scale values of RGBW color RGBW (Nx−W1, Ny−W1, Nz−W1, W1); and if yes, taking a minimum value selected from Nx−W1, Ny−W1 and Nz−W1, to represent a second conversion value W2 and making the gray scale values of RGBW color to be RGBW (Nx−W1−W2, Ny−W1−W2, Nz−W1−W2, W1+W2).

Selectively, the method also comprises: determining whether one or more than one of Nx−W1−W2, Ny−W1−W2 and Nz−W1−W2 is larger than 1; and if not, outputting the gray scale values of RGBW color RGBW(Nx−W1−W2, Ny−W1−W2, Nz−W1−W2, W1+W2); and if yes, making a coordinate value corresponding to each gray scale value of RGBW color, which is larger than 1, to be 1.

Selectively, the method also comprises: Gamma-converting the gray scale values of RGBW color RGBW (Nx−W1, Ny−W1, Nz−W1, W1).

The present disclosure also provides the RGB to RGBW brightness compensation device and the device comprises: a retrieving module, an enhancing module, a module of obtaining conversion value and a module of obtaining gray scale values of RGBW color; wherein: the retrieving module is used to retrieve multiple gray scale values of RGB color RGB (x, y, z), wherein x is a gray scale level of a red sub-pixel of an RGB model, y is a gray scale level of a green sub-pixel of an RGB model and z is a gray scale level of a blue sub-pixel of an RGB model $0 \leq x, y, z \leq 1$; the enhancing module is used to multiply the gray scale values of RGB color RGB (x, y, z) by N to obtain multiple enhanced gray scale values of RGB color RGB (Nx, Ny, Nz), wherein $1 < N \leq 4/3$; the module of obtaining conversion value is used to make a minimum value selected from x, y, z to represent a first conversion value W1; and the module of obtaining gray scale values of RGBW color is used to retrieve multiple gray scale values of RGBW color RGBW (Nx−W1, Ny−W1, Nz−W1, W1), according to the enhanced gray scale values of RGB color RGB (Nx, Ny, Nz) and the first conversion value W1.

Selectively, N is 4/3.

Selectively, the device also comprises: a first determining module and an output module; wherein: the first determining module is used to determine whether one or more than one of Nx−W1, Ny−W1 and Nz−W1 is larger than 1; and when one or more than one value is not larger than 1, the output module outputs the gray scale values of RGBW color RGBW (Nx−W1, Ny−W1, Nz−W1, W1), and when one or more than one value is larger than 1, the output module makes a minimum value selected from Nx−W1, Ny−W1 and Nz−W1 taken to represent a second conversion value W2, and outputs that the gray scale values of RGBW color are RGBW (Nx−W1−W2, Ny−W1−W2, Nz−W1−W2, W1+W2).

Selectively, the device also comprises: a second determining module, wherein: the second determining module is used to determine whether one or more than one of Nx−W1−W2, Ny−W1−W2 and Nz−W1−W2 is larger than 1; and when one or more than one value is not larger than 1, the output module is used to output the gray scale values of RGBW color RGBW (Nx−W1−W2, Ny−W1−W2, Nz−W1−W2, W1+W2), and when one or more than one value is larger than 1, the output module makes a coordinate value corresponding to each gray scale value of RGBW color, which is larger than 1, to be 1 and then to output.

Selectively, the device also comprises: the Gamma module, wherein the Gamma module is used to Gamma-convert the gray scale values of RGBW color RGBW (Nx−W1, Ny−W1, Nz−W1, W1).

With the implementation of the embodiment of the present disclosure, the enhanced gray scale values of RGB color RGB (Nx, Ny, Nz) are obtained from the gray scale values of RGB color RGB (x, y, z) multiplied by N, wherein $1 < N \leq 4/3$. Thus, a less-brightness problem caused by the smaller size of the RGB sub-pixels can be overcome.

BRIEF DESCRIPTION OF THE DRAWINGS

In order to more clearly illustrate the embodiments of the present disclosure or prior art, the following figures will be described in the embodiments are briefly introduced. It is obvious that the drawings are merely some embodiments of the present disclosure, those of ordinary skill in this field can obtain other figures according to these figures without paying the premise.

DETAILED DESCRIPTION OF THE PREFERRED EMBODIMENTS

Embodiments of the present disclosure are described in detail with the technical matters, structural features, achieved objects, and effects with reference to the accompanying drawings as follows. It is clear that the described embodiments are part of embodiments of the present disclosure, but not all embodiments. Based on the embodiments of the present disclosure, all other embodiments to those of ordinary skill in the premise of no creative efforts obtained, should be considered within the scope of protection of the present disclosure.

Specifically, the terminologies in the embodiments of the present invention are merely for describing the purpose of the certain embodiment, but not to limit the invention. Examples and the appended claims be implemented in the present invention requires the use of the singular form of the book "an", "the" and "the" are intended to include most forms unless the context clearly dictates otherwise. It should also be understood that the terminology used herein that "and/or" means and includes any or all possible combinations of one or more of the associated listed items.

Figure 1:
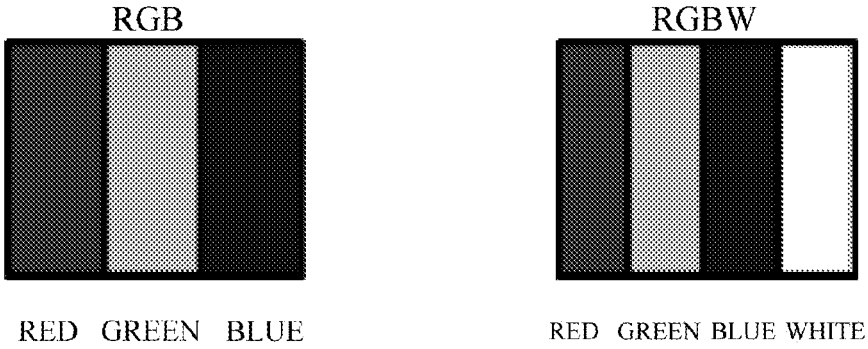
FIG. 1 (PRIOR ART)
FIG. 1 is a comparison diagram of an RGB model and the RGBW model of the prior art.
Figure 2:
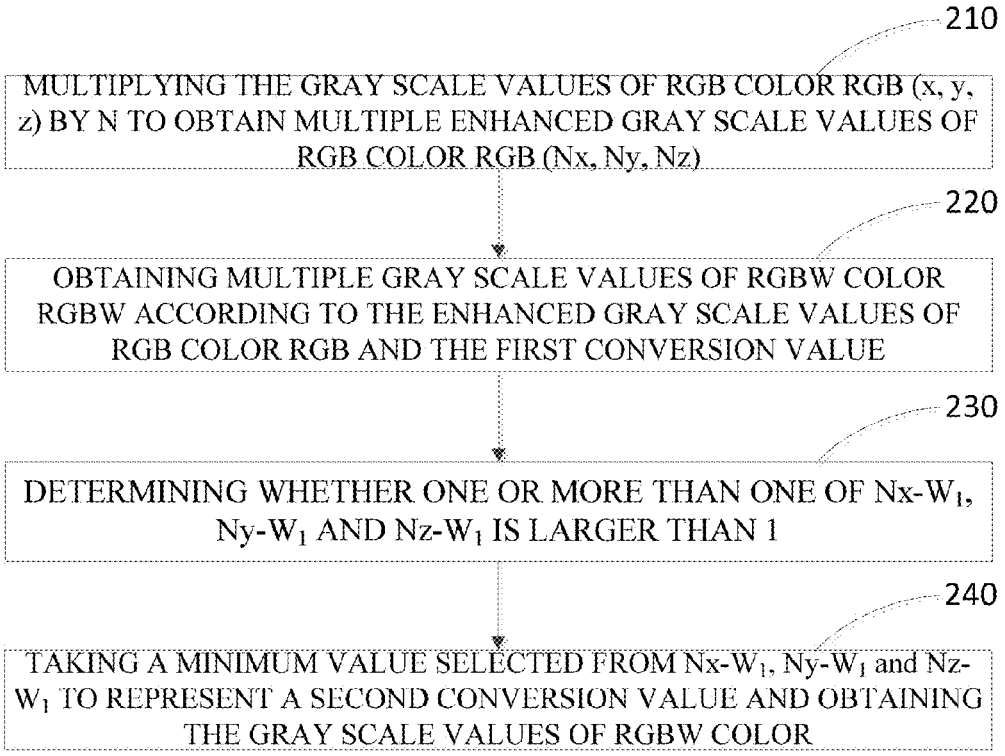
FIG. 2 is a flow chart of an embodiment of an RGB to RGBW brightness compensation method of the present disclosure.

Please refer to FIG. 2. FIG. 2 is a flow chart of an embodiment of an RGB to RGBW brightness compensation method of the present disclosure. The present embodiment of the RGB to RGBW brightness compensation method comprises following steps.

210: retrieving multiple gray scale values of RGB color RGB (x, y, z), wherein x is a gray scale level of a red sub-pixel of an RGB model, y is a gray scale level of a green sub-pixel of an RGB model and z is a gray scale level of a blue sub-pixel of an RGB model $0 \leq x, y, z \leq 1$.

Usually, a pixel point of a liquid crystal display panel is represented by the RGB model, RGB (X, Y, Z) can represent various colors, wherein X is a gray scale level of the red sub-pixel, Y is a gray scale level of the green sub-pixel and Z is a gray scale level of the blue sub-pixel, $0 \leq X, Y, Z \leq 255$. To easily calculate, RGB (X, Y, Z) is normalized to RGB (x, y, z), $0 \leq x, y, z \leq 1$, wherein x is a normalized gray scale level of red sub-pixel, y is a normalized gray scale level of the green sub-pixel and z is a normalized gray scale level of the blue sub-pixel. A terminal directly or indirectly retrieves the gray scale values of RGB color RGB (x, y, z).

220: Multiplying the gray scale values of RGB color RGB (x, y, z) by N to obtain multiple enhanced gray scale values of RGB color RGB (Nx, Ny, Nz), wherein $1<N\leq 4/3$ and a minimum value selected from x, y, z is taken to represent a first conversion value W1.

When the RGB model is converted to the RGBW model, the sizes of the red, green and blue sub-pixels are shrunk to ¾ of the original sizes thereof. A brightness and the size of each sub-pixel are in direct ratio. Thus, when the sizes of the red, green and blue sub-pixels are shrunk, the brightness thereof are decreased correspondingly. Therefore, the gray scale values of RGB color RGB (x, y, z) are multiplied by N, $1<N\leq 4/3$, to obtain the enhanced gray scale values of RGB color RGB (Nx, Ny, Nz). For example, when RGB (x, y, z) is RGB (0.6, 0.3, 0.3) and multiplied by ⅔, RGB (Nx, Ny, Nz) is calculated to RGB (0.8, 0.4, 0.4). At the time, the minimum value selected from x, y and z is taken to represent a first conversion value W1. In the example, RGB (x, y, z) is RGB (0.6, 0.3, 0.3) so x is 0.6, y is 0.3 and z is 0.3. Therefore, the minimum value is 0.3.

230: Obtaining multiple gray scale values of RGBW color RGBW (Nx−W1, Ny−W1, Nz−W1, W1) according to the enhanced gray scale values of RGB color RGB (Nx, Ny, Nz) and the first conversion value W1.

After the enhanced gray scale values of RGB color RGB (Nx, Ny, Nz) and the first conversion value W1 are obtained, the RGBW (Nx−W1, Ny−W1, Nz−W1, W1) can be obtained. Using the foregoing example to further describe, when RGB (Nx, Ny, Nz) is RGB (0.8, 0.4, 0.4) and the first conversion value W1 is 0.3. In this case, the RGBW (Nx−W1, Ny−W1, Nz−W1, W1) is RGBW (0.8−0.3, 0.4−0.3, 0.4−0.3, 0.3) and that is RGBW (05, 0.1, 0.1, 0.3).

240: Gamma-converting the gray scale values of RGBW color RGBW (Nx−W1, Ny−W1, Nz−W1, W1).

According to the above-mentioned description, RGB (X, Y, Z) is normalized to RGB (x, y, z), so RGB (x, y, z) is Gamma-converted to recover to RGB (X, Y, Z).

Using RGB (0.6, 0.3, 0.3) as an example, with the implementation of the foregoing embodiment, the real converted brightness is RGBW (0.3*¾, 0, 0, 0.3*¾) without the multiplying step. After the multiplying step, the real brightness is RGBW (0.5*¾, 0.1*¾, 0.1*¾, 0.3*¾). Compared with the two RGBWs, the brightness of the enhanced pixel is increased apparently.

Figure 3:
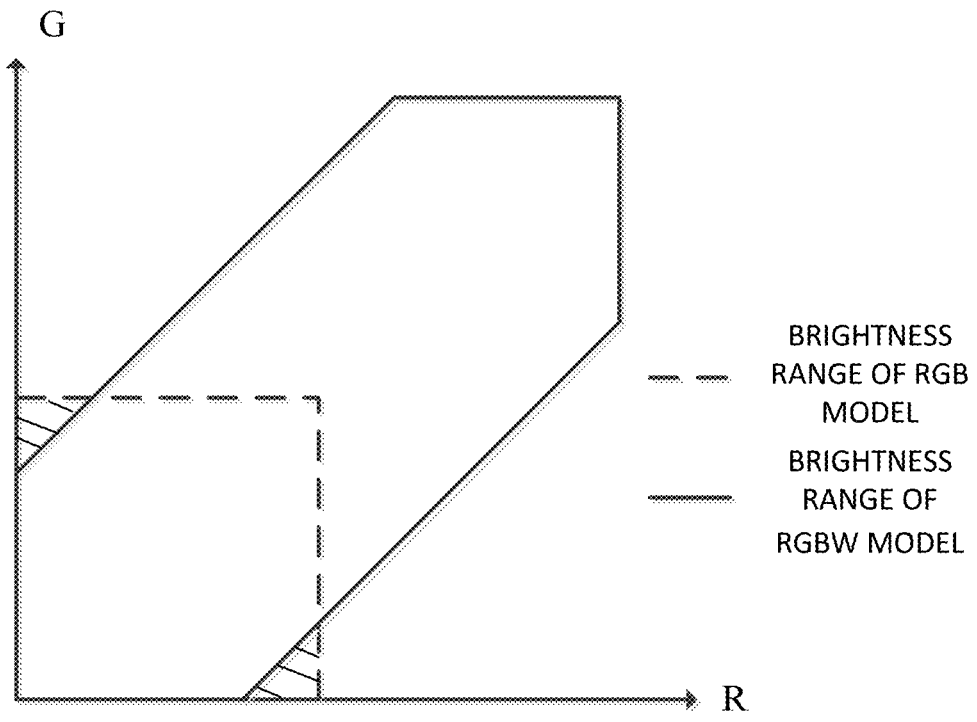
FIG. 3 is a brightness comparison diagram of an RGB model and the RGBW model of the prior art.

And, as shown in FIG. 3, the RGBW model necessarily has this problem, for example, when the pixel point displays the red RGB (1, 0, 0), a converted value should be RGBW (1, 0, 0, 0), but the real converted value is RGBW (¾, 0, 0, 0) since the brightness and the size are in direct ratio, the size of the red sub-pixel is shrunk to ¾ thereof and the real brightness maximum is reduced to ¾ thereof. Apparently, the brightness of the red sub-pixel are below standards. In FIG. 3, multiple pixel points of the shadow part have the same problem.

Figure 4:
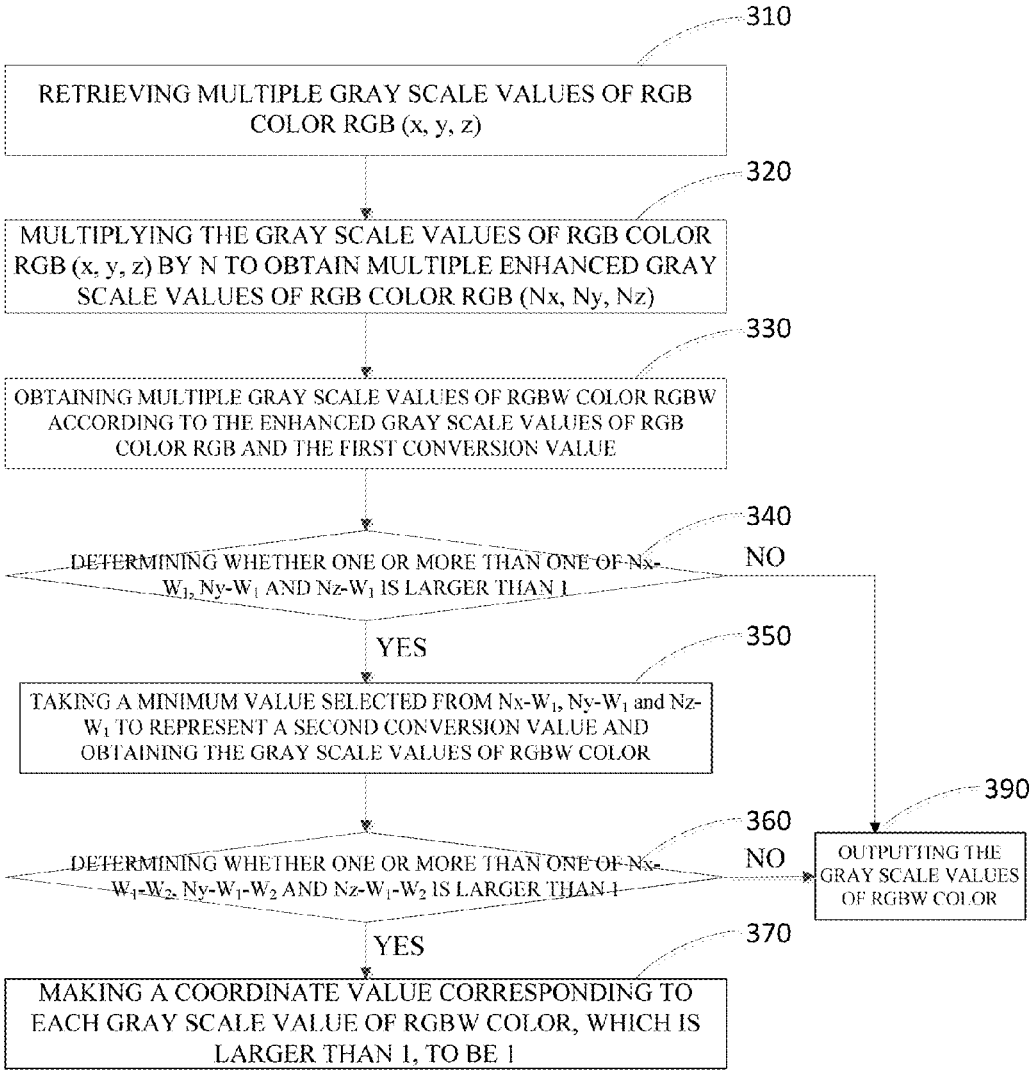
FIG. 4 is a flow chart of another embodiment of an RGB to RGBW brightness compensation method of the present disclosure.

Please refer to FIG. 4. FIG. 4 is a flow chart of another embodiment of an RGB to RGBW brightness compensation method of the present disclosure. The embodiment of the RGB to RGBW brightness compensation method comprises the steps.

310: Retrieving multiple gray scale values of rgb color rgb (x, y, z), wherein x is a gray scale level of a red sub-pixel of an RGB model, y is a gray scale level of a green sub-pixel of an RGB model and z is a gray scale level of a blue sub-pixel of an RGB model $0\leq x, y, z\leq 1$.

Usually, a pixel point of a liquid crystal display panel is represented by the RGB model, RGB (X, Y, Z) can represent various colors, wherein X is a gray scale level of the red sub-pixel, Y is a gray scale level of the green sub-pixel and Z is a gray scale level of the blue sub-pixel, $0\leq X, Y, Z\leq 255$. To easily calculate, RGB (X, Y, Z) is normalized to RGB (x, y, z), $0\leq x, y, z\leq 1$, wherein x is a normalized gray scale level of red sub-pixel, y is a normalized gray scale level of the green sub-pixel and z is a normalized gray scale level of the blue sub-pixel. A terminal directly or indirectly retrieves the gray scale values of RGB color RGB (x, y, z).

320: Multiplying the gray scale values of RGB color RGB (x, y, z) by N to obtain multiple enhanced gray scale values of RGB color RGB (Nx, Ny, Nz), wherein $1<N\leq 4/3$ and a minimum value selected from x, y, z is taken to represent a first conversion value W1.

When the RGB model is converted to the RGBW model, the sizes of the red, green and blue sub-pixels are shrunk to ¾ of the original sizes thereof. A brightness and size of each sub-pixel are in direct ratio. Thus, when the sizes of the red, green and blue sub-pixels are shrunk, the brightness thereof are decreased correspondingly. Therefore, the gray scale values of RGB color RGB (x, y, z) are multiplied by N, $1<N\leq 4/3$, to obtain the enhanced gray scale values of RGB color RGB (Nx, Ny, Nz). For example, when RGB (x, y, z) is RGB (1, 0.1, 0.1) and multiplied by ⅔, RGB (Nx, Ny, Nz) is calculated to RGB (⅔, 4/30, 4/30). At the time, the minimum value selected from x, y, z is taken to represent a first conversion value W1. In the example, when RGB (x, y, z) is RGB (1, 0.1, 0.1), x is 1, y is 0.1 and z is 0.1. Therefore, the minimum value is 0.1.

330: Obtaining multiple gray scale values of RGBW color RGBW (Nx−W1, Ny−W1, Nz−W1, W1) according to the enhanced gray scale values of RGB color RGB (Nx, Ny, Nz) and the first conversion value W1.

After the enhanced gray scale values of RGB color RGB (Nx, Ny, Nz) and the first conversion value W1 are obtained, RGBW (Nx−W1, Ny−W1, Nz−W1, W1) can be obtained. Using the foregoing example to further describe, when RGB (Nx, Ny, Nz) is RGB (⅔, 4/30, 4/30) and the first conversion value W1 is 0.1. In this case, RGBW (Nx−W1, Ny−W1, Nz−W1, W1) is RGBW (40/30−3/30, 4/30−3/30, 4/30−3/30, 3/30) and that is RGBW (37/30, 1/30, 1/30, 3/30).

340: Determining whether one or more than one of Nx−W1, Ny−W1 and Nz−W1 is larger than 1.

If one or more than one of Nx−W1, Ny−W1 and Nz−W1 is larger than 1, RGBW (Nx−W1, Ny−W1, Nz−W1, W1) overflows. For example, if RGBW (Nx−W1, Ny−W1, Nz−W1, W1) is RGBW (37/30, 1/30, 1/30, 3/30), 37/30 is larger than 1, RGBW (Nx−W1, Ny−W1, Nz−W1, W1) overflows and go to a step 350. If one or more than one of Nx−W1, Ny−W1 and Nz−W1 is not larger than 1, go to a step 380.

350: Taking a minimum value selected from Nx−W1, Ny−W1 and Nz−W1 to represent a second conversion value W2 and making the gray scale values of RGBW color to be RGBW (Nx−W1−W2, Ny−W1−W2, Nz−W1−W2, W1+W2).

For example, when RGBW (Nx−W1, Ny−W1, Nz−W1, W1) is RGBW (37/30, 1/30, 1/30, 3/30), the minimum value selected from 37/30, 1/30, and 1/30 is 1/30. Thus, W2 is 1/30. The gray scale values of RGBW color RGBW (Nx−W1−W2, Ny−W1−W2, Nz−W1−W2, W1+W2) are RGBW (36/30, 0, 0, 4/30).

360: Determining whether one or more than one of Nx−W1−W2, Ny−W1−W2 and Nz−W1−W2 is larger than 1.

It is determined whether one or more than one of Nx−W1−W2, Ny−W1−W2 and Nz−W1−W2 is larger than 1. If yes, go to a step 370, but if not, go to a step 380. For embodiment, if RGBW (Nx−W1−W2, Ny−W1−W2, Nz−W1−W2, W1+W2) is RGBW ($\frac{36}{30}$, 0, 0, $\frac{4}{30}$), $\frac{36}{30}$ is larger than 1, so go to the step 370.

370: Making a coordinate value corresponding to each gray scale value of RGBW color, which is larger than 1, to be 1.

If one or more than one of the coordinates of Nx−W1−W2, Ny−W1−W2 and Nz−W1−W2 in RGBW (Nx−W1−W2, Ny−W1−W2, Nz−W1−W2, W1+W2) is larger than 1, the coordinate, which is larger than 1, is set to 1. For example, if RGBW (Nx−W1−W2, Ny−W1−W2, Nz−W1−W2, W1+W2) is RGBW ($\frac{36}{30}$, 0, 0, $\frac{4}{30}$), $\frac{36}{30}$ is larger than 1 so RGBW (Nx−W1−W2, Ny−W1−W2, Nz−W1−W2, W1+W2) is RGBW (1, 0, 0, $\frac{4}{30}$).

380: Outputting the gray scale values of RGBW color.

With the implementation of the embodiment of the present disclosure, the enhanced gray scale values of RGB color RGB (Nx, Ny, Nz) are obtained from the gray scale values of RGB color RGB (x, y, z) multiplied by N, wherein $1<N\leq\frac{4}{3}$. Thus, a less-brightness problem caused by the smaller size of the RGB sub-pixels can be overcome.

Figure 5:
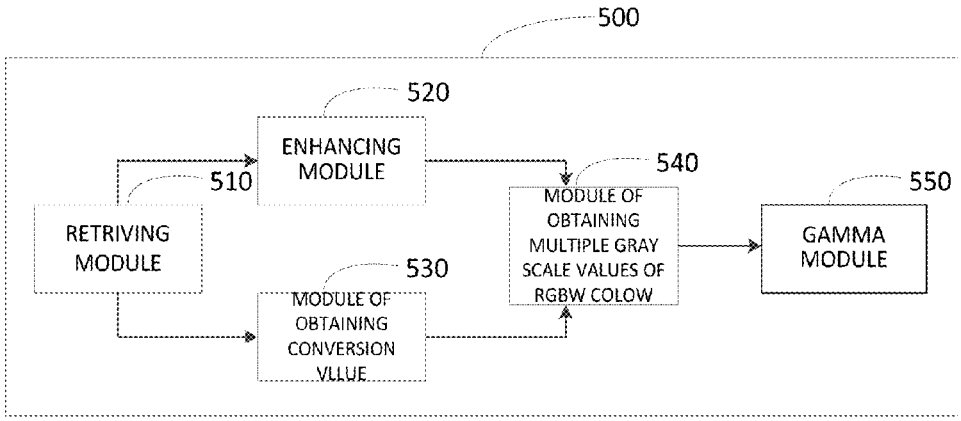
FIG. 5 is a schematic structural diagram of an embodiment of an RGB to RGBW brightness compensation device of the present disclosure.

Please refer to FIG. 5. FIG. 5 is a schematic structural diagram of an embodiment of an RGB to RGBW brightness compensation device of the present disclosure. The RGB to RGBW brightness compensation device 500 comprises: a retrieving module 510, an enhancing module 520, a module of obtaining conversion value 530, a module of obtaining multiple gray scale values of RGBW color 540 and a Gamma module 550.

The retrieving module 510 is used to retrieve the gray scale values of RGB color RGB (x, y, z), wherein x is a gray scale level of a red sub-pixel of an RGB model, y is a gray scale level of a green sub-pixel of an RGB model and z is a gray scale level of a blue sub-pixel of an RGB model $0\leq x, y, z\leq 1$.

Usually, a pixel point of a liquid crystal display panel is represented by the RGB model, RGB (X, Y, Z) can represent various colors, wherein X is a gray scale level of the red sub-pixel, Y is a gray scale level of the green sub-pixel and Z is a gray scale level of the blue sub-pixel, $0\leq X, Y, Z\leq 255$. To easily calculate, RGB (X, Y, Z) is normalized to RGB (x, y, z), $0\leq x, y, z\leq 1$, wherein x is a normalized gray scale level of red sub-pixel, y is a normalized gray scale level of the green sub-pixel and z is a normalized gray scale level of the blue sub-pixel. The retrieving module 510 is used to retrieve the gray scale values of RGB color RGB (x, y, z).

The enhancing module 520 is used to multiply the gray scale values of RGB color RGB (x, y, z) by N to obtain multiple enhanced gray scale values of RGB color RGB (Nx, Ny, Nz), wherein $1<N\leq\frac{4}{3}$.

When the RGB model is converted to the RGBW model, the sizes of the red, green and blue sub-pixels are shrunk to $\frac{3}{4}$ of the original sizes thereof. A brightness and size of each sub-pixel are in direct ratio. Thus, the enhancing module 520 can increase the N times of the gray scale values of RGB color RGB (x, y, z), $1<N\leq\frac{4}{3}$. The enhanced gray scale values of RGB color is RGB (Nx, Ny, Nz). For example, when RGB (x, y, z) is RGB (1, 0.1, 0.1) and multiplied by $\frac{4}{3}$, RGB (Nx, Ny, Nz) is calculated to RGB ($\frac{4}{3}$, $\frac{4}{30}$, $\frac{4}{30}$).

The module of obtaining conversion value 530 is used to make a minimum value selected from x, y and z to represent a first conversion value W1.

The module of obtaining conversion value 530 takes the minimum value selected from x, y and z to represent a first conversion value W1. In the example, RGB (x, y, z) is RGB (1, 0.1, 0.1) so x is 1, y is 0.1 and z is 0.1. Therefore, the minimum value is 0.1.

The module of obtaining gray scale values of RGBW color 540 is used to retrieve the gray scale values of RGBW color RGBW (Nx−W1, Ny−W1, Nz−W1, W1), according to the enhanced gray scale values of RGB color RGB (Nx, Ny, Nz) and the first conversion value W1.

After the enhanced gray scale values of RGB color RGB (Nx, Ny, Nz) and the first conversion value W1 are obtained, the module of obtaining gray scale values of RGBW color 540 retrieves the gray scale values of RGBW color RGBW (Nx−W1, Ny−W1, Nz−W1, W1), according to the enhanced gray scale values of RGB color RGB (Nx, Ny, Nz) and the first conversion value W1. Using the foregoing example to further describe, when RGB (Nx, Ny, Nz) is RGB (0.8, 0.4, 0.4) and the first conversion value W1 is 0.3. In this case, RGBW (Nx−W1, Ny−W1, Nz−W1, W1) is RGBW (0.8−0.3, 0.4−0.3, 0.4−0.3, 0.3) and that is RGBW (05, 0.1, 0.1, 0.3).

The Gamma module 550 is used to Gamma-convert the gray scale values of RGBW color RGBW (Nx−W1, Ny−W1, Nz−W1, W1).

Since RGB (X, Y, Z) is normalized to RGB (x, y, z), so the Gamma module 550 Gamma-converts RGB (x, y, z) to recover to RGB (X, Y, Z).

Figure 6:
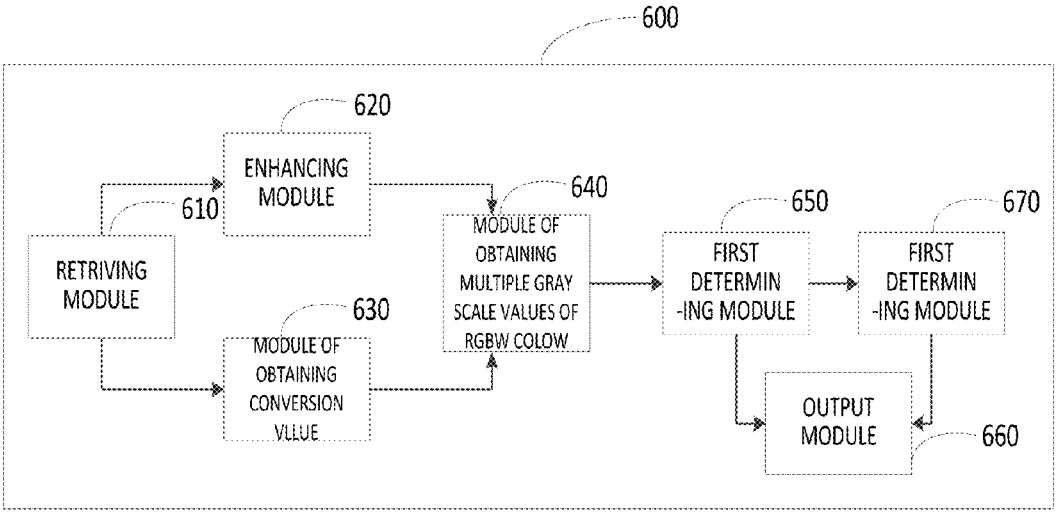
FIG. 6 is a schematic structural diagram of another embodiment of an RGB to RGBW brightness compensation device of the present disclosure.

Please refer to FIG. 6. FIG. 6 is a schematic structural diagram of another embodiment of an RGB to RGBW brightness compensation device of the present disclosure. The RGB to RGBW brightness compensation device comprises: a retrieving module 610, an enhancing module 620, a module of obtaining conversion value 630, a module of obtaining multiple gray scale values of RGBW color 640, a first determining module 650, a second determining module 670 and an output module 660.

The retrieving module 610 is used to retrieve the gray scale values of RGB color RGB (x, y, z), wherein x is a gray scale level of a red sub-pixel of an RGB model, y is a gray scale level of a green sub-pixel of an RGB model and z is a gray scale level of a blue sub-pixel of an RGB model $0\leq x, y, z\leq 1$.

Usually, a pixel point of a liquid crystal display panel is represented by the RGB model, RGB (X, Y, Z) can represent various colors, wherein X is a gray scale level of the red sub-pixel, Y is a gray scale level of the green sub-pixel and Z is a gray scale level of the blue sub-pixel, $0\leq X, Y, Z\leq 255$. To easily calculate, RGB (X, Y, Z) is normalized to RGB (x, y, z), $0\leq x, y, z\leq 1$, wherein x is a normalized gray scale level of red sub-pixel, y is a normalized gray scale level of the green sub-pixel and z is a normalized gray scale level of the blue sub-pixel. The retrieving module 610 is used to retrieve the gray scale values of RGB color RGB (x, y, z).

The enhancing module 620 is used to multiply the gray scale values of RGB color RGB (x, y, z) by N to obtain multiple enhanced gray scale values of RGB color RGB (Nx, Ny, Nz), wherein $1<N\leq\frac{4}{3}$.

When the RGB model is converted to the RGBW model, the sizes of the red, green and blue sub-pixels are shrunk to $\frac{3}{4}$ of the original sizes thereof. A brightness and size of each sub-pixel are in direct ratio. Thus, the enhancing module 620 can increase the N times of the gray scale values of RGB color RGB (x, y, z), $1<N\leq\frac{4}{3}$. The enhanced gray scale values of RGB color is RGB (Nx, Ny, Nz). For example, when RGB (x, y, z) is RGB (1, 0.1, 0.1) and multiplied by $\frac{4}{3}$, RGB (Nx, Ny, Nz) is calculated to RGB ($\frac{4}{3}$, $\frac{4}{30}$, $\frac{4}{30}$).

The module of obtaining conversion value 630 is used to take a minimum value selected from x, y and z to represent a first conversion value W1.

The module of obtaining conversion value 630 takes the minimum value selected from x, y and z to represent a first conversion value W1. For example, if RGB (x, y, z) is RGB (1, 0.1, 0.1), x is 1, y is 0.1 and z is 0.1. Therefore, the module of obtaining conversion value 630 obtains that the minimum value is 0.1.

The module of obtaining gray scale values of RGBW color 640 is used to retrieve the gray scale values of RGBW color RGBW (Nx−W1, Ny−W1, Nz−W1, W1), according to the enhanced gray scale values of RGB color RGB (Nx, Ny, Nz) and the first conversion value W1.

After the enhanced gray scale values of RGB color RGB (Nx, Ny, Nz) and the first conversion value W1 are obtained, the module of obtaining gray scale values of RGBW color 640 retrieves the gray scale values of RGBW color RGBW (Nx−W1, Ny−W1, Nz−W1, W1), according to the enhanced gray scale values of RGB color RGB (Nx, Ny, Nz) and the first conversion value W1. Using the foregoing example to further describe, when RGB (Nx, Ny, Nz) is RGB (0.8, 0.4, 0.4) and the first conversion value W1 is 0.3. In this case, RGBW (Nx−W1, Ny−W1, Nz−W1, W1) is RGBW (0.8−0.3, 0.4−0.3, 0.4−0.3, 0.3) and that is RGBW (05, 0.1, 0.1, 0.3).

The first determining module 650 is used to determine whether one or more than one of Nx−W1, Ny−W1 and Nz−W1 is larger than 1. If one or more than one of Nx−W1, Ny−W1 and Nz−W1 is larger than 1, the first determining module 650 determines that RGBW (Nx−W1, Ny−W1, Nz−W1, W1) overflows. For example, if RGBW (Nx−W1, Ny−W1, Nz−W1, W1) is RGBW ($^{37}/_{30}$, $^{1}/_{30}$, $^{1}/_{30}$, $^{3}/_{30}$), $^{37}/_{30}$ is larger than 1 so RGBW (Nx−W1, Ny−W1, Nz−W1, W1) overflows.

When one or more than one value is not larger than 1, the output module 660 is used to output the gray scale values of RGBW color RGBW (Nx−W1, Ny−W1, Nz−W1, W1). When one or more than one value is larger than 1, a minimum value selected from Nx−W1, Ny−W1 and Nz−W1 is taken to represent a second conversion value W2, the output module 660 outputs that the gray scale values of RGBW color is RGBW (Nx−W1−W2, Ny−W1−W2, Nz−W1−W2, W1+W2).

When one or more than one is not larger than 1, the output module 660 outputs the gray scale values of RGBW color RGBW (Nx−W1, Ny−W1, Nz−W1, W1). When one or more than one value is larger than 1, the output module 660 takes the minimum value selected from Nx−W1−W2, Ny−W1−W2 and Nz−W1−W2 to represent a second conversion value W2, and outputs that the gray scale values of RGBW is (Nx−W1−W2, Ny−W1−W2, Nz−W1−W2, W1+W2). For example, if RGBW (Nx−W1, Ny−W1, Nz−W1, W1) is RGBW ($^{37}/_{30}$, $^{1}/_{30}$, $^{1}/_{30}$, $^{3}/_{30}$), the minimum value selected from $^{37}/_{30}$, $^{1}/_{30}$, $^{1}/_{30}$, is $^{1}/_{30}$. Thus, W2 is $^{1}/_{30}$. The output module 600 outputs that the gray scale values of RGBW color RGBW (Nx−W1−W2, Ny−W1−W2, Nz−W1−W2, W1+W2) are RGBW ($^{36}/_{30}$, 0, 0, $^{4}/_{30}$).

The second determining module 670 is used to determine whether one or more than one of Nx−W1−W2, Ny−W1−W2 and Nz−W1−W2 is larger than 1.

For example, if RGBW (Nx−W1−W2, Ny−W1−W2, Nz−W1−W2, W1+W2) is RGBW ($^{36}/_{30}$, 0, 0, $^{4}/_{30}$), $^{36}/_{30}$ is larger than 1 and one or more than one value, which is larger than 1, is existed.

When one or more than one value is not larger than 1, the output module 660 is used to output that the gray scale values of RGBW color RGBW (Nx−W1−W2, Ny−W1−W2, Nz−W1−W2, W1+W2). When one or more than one value is larger than 1, the output module 660 makes a coordinate value corresponding to each gray scale value of RGBW color, which is larger than 1, to be 1 and outputs it. For example, if RGBW Nx−W1−W2, Ny−W1−W2, Nz−W1−W2, W1+W2) is RGBW ($^{36}/_{30}$, 0, 0, $^{4}/_{30}$), $^{36}/_{30}$ is larger than 1, so RGBW (Nx−W1−W2, Ny−W1−W2, Nz−W1−W2, W1+W2) is RGBW (1, 0, 0, $^{4}/_{30}$).

With the implementation of the embodiment of the present disclosure, the enhanced gray scale values of RGB color RGB (Nx, Ny, Nz) are obtained from the gray scale values of RGB color RGB (x, y, z) multiplied by N, wherein $1<N\leq 4/3$. Thus, a less-brightness problem caused by the smaller size of the RGB sub-pixels can be overcome.

It is understandable in practical to the person who is skilled in the art that all or portion of the processes in the method according to the aforesaid embodiment can be accomplished with the computer program to instruct the related hardwares. The program can be stored in a readable storage medium if the computer. As the program is executed, the processes of the embodiments in the aforesaid respective methods can be included. The storage medium can be a hardisk, an optical disc, a Red-Only Memory (ROM) or a Random Access Memory (RAM).

Above are embodiments of the present disclosure, which does not limit the scope of the present disclosure. Any modifications, equivalent replacements or improvements within the spirit and principles of the embodiment described above should be covered by the protected scope of the disclosure.

What is claimed is:

1. An RGB to RGBW brightness compensation method, characterized in that, the method comprises:

retrieving multiple gray scale values of RGB color RGB (x, y, z), wherein x is a gray scale level of a red sub-pixel of an RGB model, y is a gray scale level of a green sub-pixel of an RGB model and z is a gray scale level of a blue sub-pixel of an RGB model $0\leq x, y, z\leq 1$;

multiplying the gray scale values of RGB color RGB (x, y, z) by N to obtain multiple enhanced gray scale values of RGB color RGB (Nx, Ny, Nz), wherein N is $^{4}/_{3}$ and a minimum value selected from x, y, z is taken to represent a first conversion value W1;

obtaining multiple gray scale values of RGBW color RGBW (Nx−W1, Ny−W1, Nz−W1, W1) according to the enhanced gray scale values of RGB color RGB (Nx, Ny, Nz) and the first conversion value W1; and Gamma-converting the gray scale values of RGBW color RGBW (Nx−W1, Ny−W1, Nz−W1, W1);

wherein the method further comprises a step of determining whether one or more than one of Nx−W1, Ny−W1 and Nz−W1 is larger than 1, and if not, outputting the gray scale values of RGBW color RGBW (Nx−W1, Ny−W1, Nz−W1, W1); and if yes, taking a minimum value selected from Nx−W1, Ny−W1 and Nz−W1, to represent a second conversion value W2 and making the gray scale values of RGBW color to be RGBW (Nx−W1−W2, Ny−W1−W2, Nz−W1−W2, W1+W2).

2. The method according to claim 1, characterized in that, the method further comprises:

determining whether one or more than one of Nx−W1−W2, Ny−W1−W2 and Nz−W1−W2 is larger than 1; and if not, outputting the gray scale values of RGBW color RGBW(Nx−W1−W2, Ny−W1−W2, Nz−W1−W2, W1+W2); and if yes, making a coordinate value corresponding to each gray scale value of RGBW color, which is larger than 1, to be 1.

3. An RGB to RGBW brightness compensation method, characterized in that, the method comprises:

retrieving multiple gray scale values of RGB color RGB (x, y, z), wherein x is a gray scale level of a red sub-pixel of an RGB model, y is a gray scale level of a green sub-pixel of an RGB model and z is a gray scale level of a blue sub-pixel of an RGB model $0 \le x, y, z \le 1$;

multiplying the gray scale values of RGB color RGB (x, y, z) by N to obtain multiple enhanced gray scale values of RGB color RGB (Nx, Ny, Nz), wherein N is $1 \le N \le 4/3$ and a minimum value selected from x, y, z is taken to represent a first conversion value W1; and obtaining multiple gray scale values of RGBW color RGBW (Nx−W1, Ny−W1, Nz−W1, W1) according to the enhanced gray scale values of RGB color RGB (Nx, Ny, Nz) and the first conversion value W1;

wherein the method further comprises a step of determining whether one or more than one of Nx−W1, Ny−W1 and Nz−W1 is larger than 1; and if not, outputting the gray scale values of RGBW color RGBW (Nx−W1, Ny−W1, Nz−W1, W1); and if yes, taking a minimum value selected from Nx−W1, Ny−W1 and Nz−W1, to represent a second conversion value W2 and making the gray scale values of RGBW color to be RGBW (Nx−W1−W2, Ny−W1−W2, Nz−W1−W2, W1+W2).

4. The method according to claim 3, characterized in that, N is 4/3.

5. The method according to claim 3, characterized in that, the method further comprises:

determining whether one or more than one of $Nx-W_1-W_2$, $Ny-W_1-W_2$ and $Nz-W_1-W_2$ is larger than 1; and if not, outputting the gray scale values of RGBW color RGBW($Nx-W_1-W_2$, $Ny-W_1-W_2$, $Nz-W_1-W_2$, $W_1+W_2$); and if yes, making a coordinate value corresponding to each gray scale value of RGBW color, which is larger than 1, to be 1.

6. The method according to claim 3, characterized in that, the method further comprises:

Gamma-converting the gray scale values of RGBW color RGBW (Nx−W1, Ny−W1, Nz−W1, W1).

7. The method according to claim 4, characterized in that, the method further comprises:

determining whether one or more than one of Nx−W1−W2, Ny−W1−W2 and Nz−W1−W2 is larger than 1; and if not, outputting the gray scale values of RGBW color RGBW(Nx−W1−W2, Ny−W1−W2, Nz−W1−W2, W1+W2); and if yes, making a coordinate value corresponding to each gray scale value of RGBW color, which is larger than 1, to be 1.

8. An RGB to RGBW brightness compensation device, characterized in that, the device comprises: a retrieving module, an enhancing module, a module of obtaining conversion value and a module of obtaining gray scale values of RGBW color; wherein:

the retrieving module is used to retrieve multiple gray scale values of RGB color RGB (x, y, z), wherein x is a gray scale level of a red sub-pixel of an RGB model, y is a gray scale level of a green sub-pixel of an RGB model and z is a gray scale level of a blue sub-pixel of an RGB model $0 \le x, y, z \le 1$;

the enhancing module is used to multiply the gray scale values of RGB color RGB (x, y, z) by N to obtain multiple enhanced gray scale values of RGB color RGB (Nx, Ny, Nz), wherein $1 < N \le 4/3$;

the module of obtaining conversion value is used to make a minimum value selected from x, y, z to represent a first conversion value W1; and the module of obtaining gray scale values of RGBW color is used to retrieve multiple gray scale values of RGBW color RGBW (Nx−W1, Ny−W1, Nz−W1, W1), according to the enhanced gray scale values of RGB color RGB (Nx, Ny, Nz) and the first conversion value W1;

the device further comprises: a first determining module and an output module; wherein:

the first determining module is used to determine whether one or more than one of Nx−W1, Ny−W1 and Nz−W1 is larger than 1; and when one or more than one value is not larger than 1, the output module outputs the gray scale values of RGBW color RGBW (Nx−W1, Ny−W1, Nz−W1, W1), and when one or more than one value is larger than 1, the output module makes a minimum value selected from Nx−W1, Ny−W1 and Nz−W1 taken to represent a second conversion value W2, and outputs that the gray scale values of RGBW color are RGBW (Nx−W1−W2, Ny−W1−W2, Nz−W1−W2, W1+W2).

9. The device according to claim 8, characterized in that, N is 4/3.

10. The device according to claim 8, characterized in that, the device further comprises: a second determining module, wherein:

the second determining module is used to determine whether one or more than one of $Nx-W_1-W_2$, $Ny-W_1-W_2$ and $Nz-W_1-W_2$ is larger than 1; and when one or more than one value is not larger than 1, the output module is used to output the gray scale values of RGBW color RGBW ($Nx-W_1-W_2$, $Nz-W_1-W_2$, $W_1+W_2$), and when one or more than one value is larger than 1, the output module makes a coordinate value corresponding to each gray scale value of RGBW color, which is larger than 1, to be 1 and then to output.

11. The device according to claim 8, characterized in that, the device further comprises: a Gamma module, wherein:

the Gamma module is used to Gamma-convert the gray scale values of RGBW color RGBW (Nx−W1, Ny−W1, Nz−W1, W1).

* * * * *